United States Patent [19]

Miller et al.

[11] 4,263,735

[45] Apr. 28, 1981

[54] MICROFICHE STORAGE DEVICE

[76] Inventors: Norman K. Miller; George Lipko, both of Concord Industrial Park, Concordville, Pa. 19331

[21] Appl. No.: 51,006

[22] Filed: Jun. 22, 1979

[51] Int. Cl.[3] ..... B42F 17/00

[52] U.S. Cl. ..... 40/373; 40/391; 40/405; 40/159

[58] Field of Search ..... 40/124, 124.2, 124.4, 40/405, 401, 391, 373, 158 R, 158 B, 159, 10 D, 359, 360; 428/134, 136; 150/39; 312/184, 185, 187

[56] References Cited

U.S. PATENT DOCUMENTS

| | | | |
|---|---|---|---|
| 1,320,683 | 11/1919 | Goodhue | 40/537 |
| 2,477,886 | 8/1949 | McCaskill | 40/405 X |
| 3,837,106 | 9/1974 | Lofstrom et al. | 40/124.2 X |
| 3,959,904 | 6/1976 | Holliday | 40/124.2 |
| 4,008,742 | 2/1977 | Lemler | 40/124.2 |
| 4,055,010 | 10/1977 | Fridlund | 40/124.2 X |
| 4,155,645 | 5/1979 | Miller | 211/55 X |

*Primary Examiner*—John F. Pitrelli
*Assistant Examiner*—G. Lee Skillington
*Attorney, Agent, or Firm*—Robert K. Youtie

[57] ABSTRACT

A storage device for microfiche and the like, wherein a pair of sheets are secured in facing relation, one of which is provided with a plurality of parallel slits each having downturned end portions to define a flap swingable forwardly to open a slot for removably receiving microfiche, and the other sheet is cut to define a plurality of inverted generally U-shaped sheet formations having their upper bight regions secured to the flaps for outward swinging therewith and unobstructed reception of microfiche into said slots.

6 Claims, 9 Drawing Figures

FIG. 1
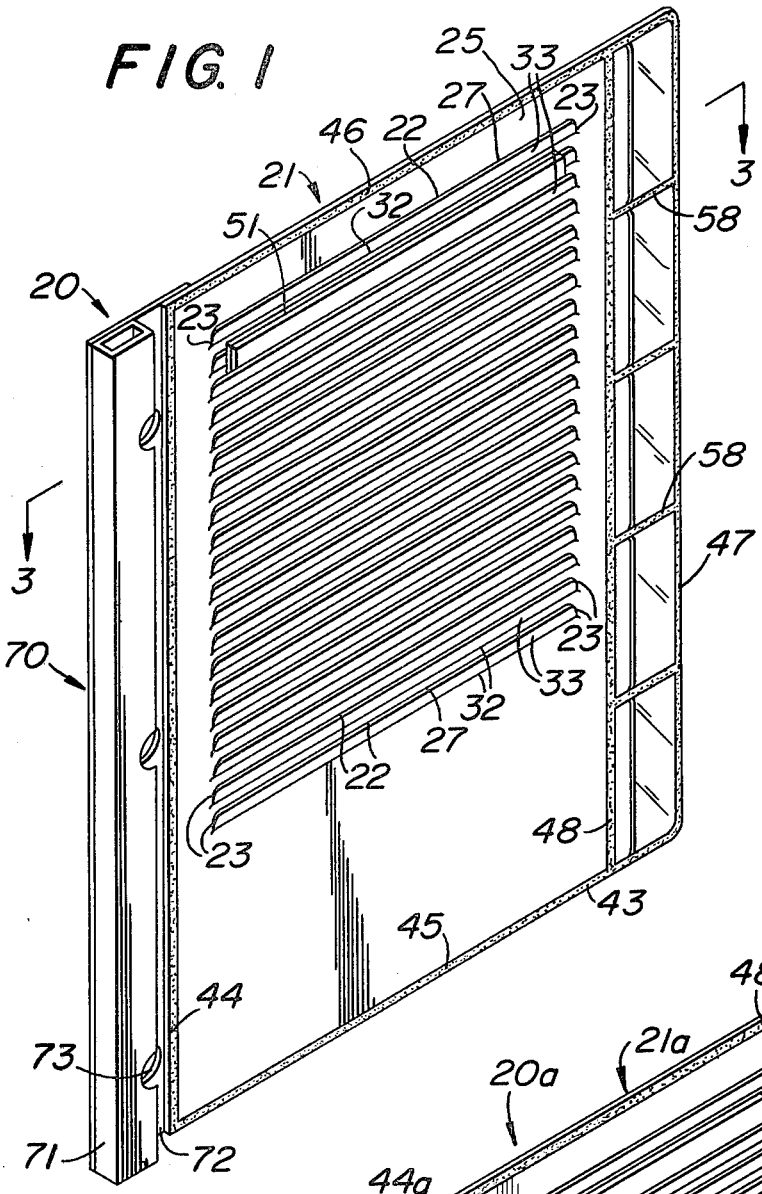
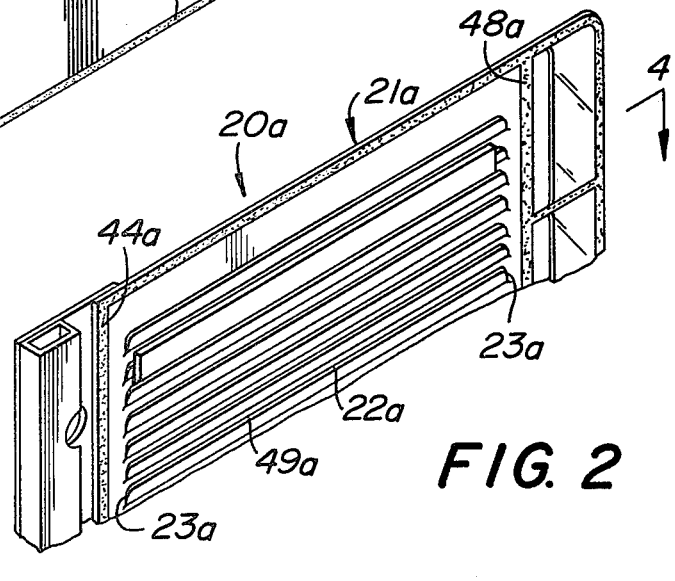
FIG. 2

FIG. 5
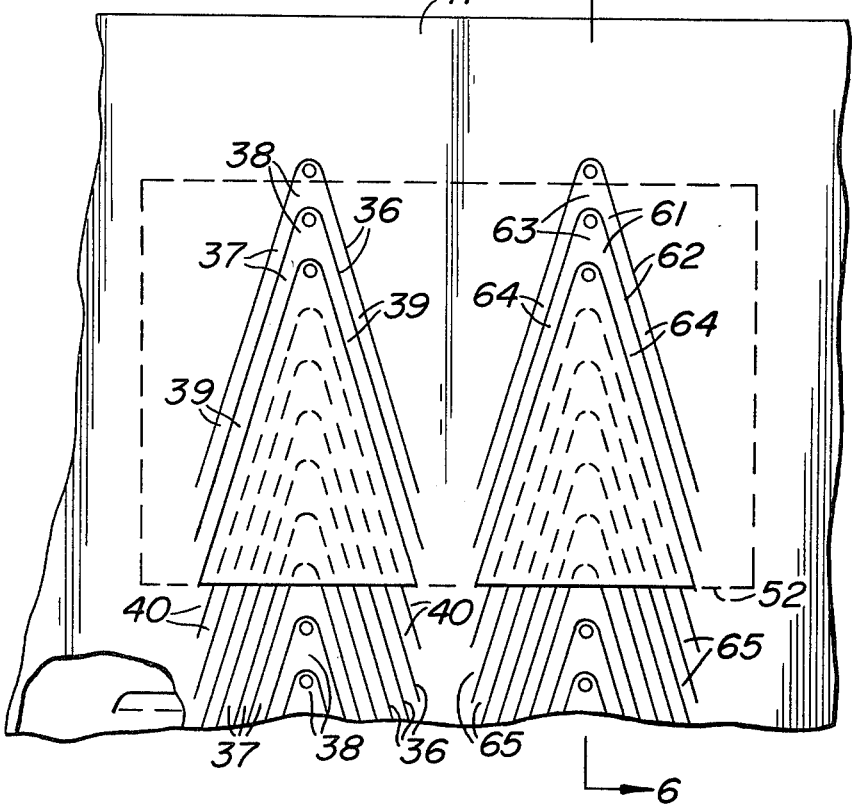
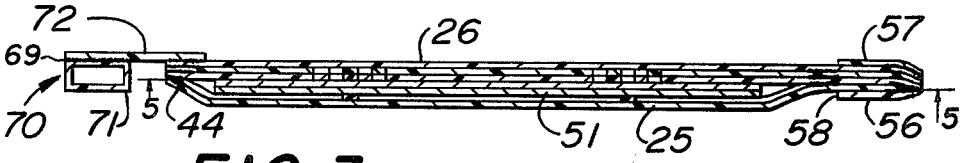
FIG. 3
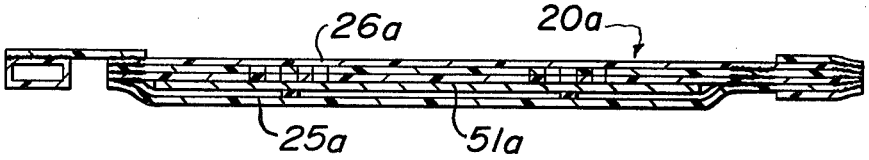
FIG. 4

MICROFICHE STORAGE DEVICE

BACKGROUND OF THE INVENTION

The prior art has provided a variety of storage devices for microfiche cards and the like, but such storage devices have been lacking in certain respects. For example, prior microfiche storage devices have not been entirely foolproof in receiving microfiche without obstructing or snagging the same, so as to require two handed operation. Additionally, prior microfiche storage devices have not been versatile in adapting to alternative mounting devices, as in ring binders, suspension rods, and the like. Examples of such microfiche storage devices may be found in the below listed prior U.S. Pat. Nos.:

Miller: 4,155,645
Fridlund et al: 4,055,010
Mazur: 2,959,879

SUMMARY OF THE INVENTION

Accordingly, it is an important object of the present invention to provide a storage device for microfiche and the like, which overcomes the above mentioned difficulties, being readily capable of both manual microfiche withdrawal and insertion by a single hand operation, in which is further uniquely well adapted for use in a variety of alternate supporting structures without alteration, and which achieves substantial savings in costs by advantageous adaptability to mass production techniques.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a perspective view showing a microfiche storage device constructed in accordance with the teachings of the present invention and particularly well-suited for storing of multiple or relatively thick microfiche cards.

FIG. 2 is a partial perspective view showing a microfiche storage device similar to FIG. 1, but illustrating a structural modification of the present invention facilitating the storage of thin or single microfiche cards.

FIG. 3 is a transverse sectional view taken generally along the line 3—3 of FIG. 1.

FIG. 4 is a transverse sectional view taken generally along the line 4—4 of FIG. 2.

FIG. 5 is a vertical sectional view taken generally along the line 5—5 of FIG. 3.

DESCRIPTION OF THE PREFERRED EMBODIMENTS

Figure 6:
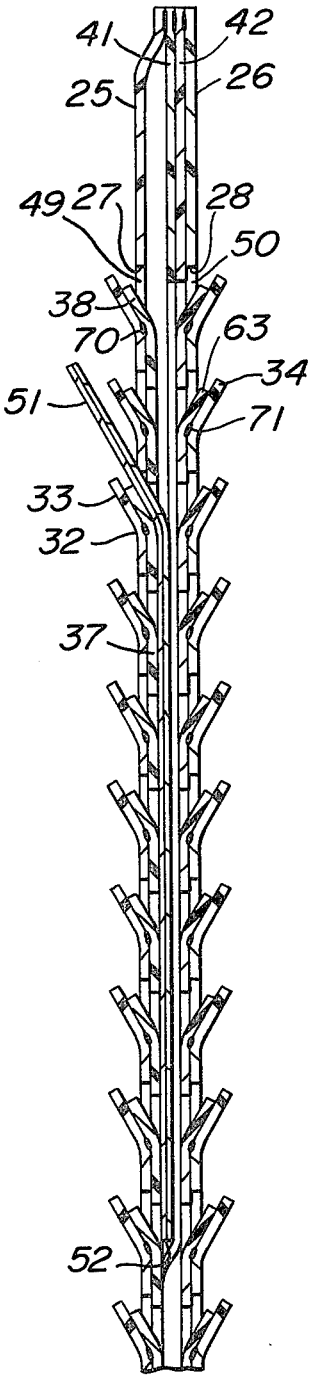
FIG. 6 is a sectional elevational view taken generally along the line 6—6 of FIG. 5.

Referring now more particularly to the drawings, and specifically to FIG. 1 thereof, a microfiche storage device is there generally designated 20, and includes a generally rectangular panel 21, which may advantageously be essentially identical on both faces, so that only a single face or side need be shown.

The panel 21 includes a pair of relatively stiff outer sheets 25 and 26, of generally congruent rectangular formation in facing relation with each other. Each of the generally rectangular outer sheets 25 and 26 are formed with a plurality of generally parallel horizontally extending slits or cuts, as at 27 on outer sheet 25 and 28 on outer sheet 26. The slits or cuts 27 are all identical, being formed in a generally vertical row extending downwardly from the upper region of the outer sheet 25 to a location spaced above the lower edge of the latter outer sheet. Specifically, each slit or cut 27 may be defined by a generally straight, horizontally disposed medial portion, as at 22, and terminates at its opposite ends in a pair of downturned opposite end portions 23. Further, the outer sheet 25 is further formed with a plurality of generally horizontal, laterally extending parallel folds or creases, as at 32, each extending between and terminating at the distal ends of opposite end portions 23 of a respective slit or cut 27. It will thus be apparent that the creases 32 extend generally parallel to the medial slit portion 22, each crease and its associated slit 27 combining to define a generally rectangular sheet region bounded there within and defining a flap 33. The flaps 33 each normally extend obliquely upwardly and outwardly from its respective crease 32, and are hingedly connected thereby to the associated sheet 25.

On the inner side of and in facing relation with each of the outer sheets 25 and 26 is a respective inner sheet 41 and 42. The inner sheets 41 and 42 are generally congruent to each other and the outer sheets, and are advantageously fabricated of material having more flexibility than that of the outer sheets, as by utilizing a plastic sheet having a greater percentage of plasticizer. Both the outer and inner sheets 25, 26, 41 and 42 may advantageously be fabricated of thermoplastic or thermoplastic coated sheeting, for economy and convenience in manufacture.

The relative flexible inner sheets 41 and 42 are sandwiched in facing relation with each other between respectively adjacent outer sheets 25 and 26, and may be substantially identical to each other. Securing the outer sheets 25 and 26, and the inner sheets 41 and 42 together may be a circumferentially extending securement or weld 43, which may be constituted of an inner edge weld or securement 44, lower and upper edge welds or securements 45 and 46, and an outer edge weld or securement 47. Extending generally parallel to and spaced inward of the outer edge weld 47 is an additional weld 48. Thus, the inner edge weld 44 extends adjacent to and spaced inwardly from inner slit ends 23, while the additional weld 48 extends adjacent to and along the outer slit end portions 23. Further, there is no sheet securement between the inner slit end portions 23 and inner weld 44, nor between the outer slit end portions 23 and the additional weld 48. It will therefore become apparent hereinafter that the spacing between the inner slit ends 23 and adjacent securement or weld 44, and the outer slit end portions 23 and their adjacent securement or weld 48 may determine the thickness or number of microfiche to be stored or held in each slot, as at 49 and 50, respectively, defined behind flaps 33 of sheet 25 and 34 of sheet 26. For example, as shown in FIGS. 1 and 3, the spacing between slit end portions 23 and securement means or welds 44 and 48 is relatively distant to permit of inserting a pair of microfiche, or a double thickness of microfiche, as at 51.

Secured outwardly of each outer sheet 25 and 26, adjacent to the outer edge thereof, may be a clear pocket sheet, as at 56 and 57. More specifically, a plurality of generally vertically spaced, horizontally extending securement zones or welds 58, as seen in FIG. 1, may extend between the vertically extending securement zones or welds 48 and 47 to secure the sheet 56 in place, leaving one edge 58 of sheet 56 unsecured, to define pockets for removably receiving suitable indicia slips, as desired.

One of the inner sheets 41 is best seen in FIG. 5, as being formed with a plurality of generally inverted U-shaped cuts 36 disposed in conformably nesting relation one within the other. The several nesting inverted U-shaped cuts 36 are arranged in a vertical row, and each adjacent pair of cuts combine to define of the material of the inner sheet 41 between the adjacent pair of cuts an inverted generally U-shaped sheet formation 37. Each U-shaped sheet formation includes a medial or intermediate bight region 38, from which extend a pair of laterally spaced depending legs 39. The formations 37 have their medial or bight regions 38 free of the sheet 41, and the legs 39 depend from the upper free portion 38 to respective junctures 40 with the remaining portion of sheet 41.

Adjacent to and spaced laterally from the generally vertical row of nesting inverted U-shaped sheet formations 37 are a similar plurality of nested inverted U-shaped sheet formations 61 disposed in a vertical row adjacent to and spaced laterally from the vertical row of formations 37. The formations 61 may be defined by a plurality of generally inverted U-shaped cuts 62 formed in the inner sheet 41 in nesting relation one within the other. The thus defined U-shaped sheet formations 61 each include a free upper or intermediate portion 63 and a pair of laterally spaced depending legs 64, the legs having their lower ends terminating at junctures 65 with the remainder of sheet 41. While a pair of vertical rows of nesting U-shaped formations 37 and 61 are shown and described, it will be appreciated that a single such vertical row of formations, or more than two may be employed, if desired.

The sheet 42 may be similarly cut to define one or more vertical rows of inverted generally U-shaped formations, which may be identical to that illustrated and described hereinbefore with respect to inner sheet 41.

In the assembled relation of the inner sheets 41 and 42 in facing relation with the inner faces or sides of respective outer sheets 25 and 26, the free intermediate or upper portions 38 and 63 of the several inverted U-shaped formations 37 and 61 may each be respectively secured to the outer sheets 25 and 26, as at locations 70 and 71 between respective slits or cuts 27 and 28. Specifically, the securement of the upper free portions 38 and 63 is advantageously by thermoplastic welding, or the like, and located at least partially on the respective flaps 33 and 34 for flexure of the portions 38 and 63 with their respective flaps. In the illustrated embodiment of FIG. 6, the securements or welds 70 and 71 are located along the creases, as at 32, so as to be secured at least partially to the flaps for obliquely outwardly swinging movement therewith for unobstructed passage thereby of the microfiche.

The slots 49 and 50 each combine with the adjacent pair of inverted U-shaped formations having their upper portions secured above and below the respective slot to define a pocket for receiving a microfiche or card, as at 51. As best seen in FIG. 6, the microfiche or card 51 extends inwardly beneath the upper portion 38 of the next adjacent upper formation 37 and over the upper portion 38 of the next adjacent lower formation, depending on the outerside of the legs 39 of the next adjacent upper formation and on the innerside of the legs 39 of the next adjacent lower formation. In this condition, the microfiche or card 51 depends to its lower edge 52 in limiting engagement with the junctures 40 of the receiving formations 37. This condition is, of course, repeated for each microfiche card in each slot.

In addition to the foregoing, there is provided along the inner edge of rectangular panel 21, as along the securement or weld 44 and secured thereby to the panel 21, a mounting structure 70 for mounting the microfiche storage device 20, as in a ring binder, suspension cabinet, or other. In particular, the mounting structure may include a tubular or tunnel formation 71, which may be of relatively stiff plastic sheet material, extending along and spaced from the inner edge securement zone 44 of panel 21. A flexible connection member or sheet 72 may extend laterally between the inner edge of panel 21 and the tube 71, being suitably secured to the panel as by weld 44, and to the tube 71, as by a weld 69, see FIG. 3. Thus, the panel 21 is connected to the tube 71, and the tube may be employed for suspending the panel in a suspension type cabinet, carousel, file drawer or the like. In addition, there may be provided a plurality of through holes, as at 73, formed in the mounted structure 70, for receiving alternate mounting means, such as ring binder, pin binder, or other. Of course, the connection sheet 72 will afford a swingability, as by the flexibility of the connection sheet to the panel 21 for convenient access thereto without removal from the binder.

Referring now to FIGS. 2 and 4, the embodiment thereof is generally designated **20*a*, and substantially identical to the embodiment of FIGS. 1 and 3 including stiff outer sheets 25*a* and 26*a*, with the exception that the vertical securement zones or welds 44 and 48 of panel 21 are relatively remotely spaced from their adjacent ends 23 of slits 22, to thereby afford access to and holding action for the relatively great thickness of microfiche 51**.

In the embodiment shown in FIGS. 2 and 4, the panel **21*a* has its corresponding securement lines or welds 44*a* and 48*a* relatively close to the adjacent ends 23*a* of cuts 22*a*. By this selective spacing, the access through and holding power of slots 49*a* is satisfactory for relatively thin, or single thickness microfiche, as at 51*a*. Thus, by the instant microfiche holder construction with the circumferential securement 43 including the vertical securement zones 44 and 48**, the holder may be adapted for holding microfiche of different thicknesses without the microfiche being held loosely or subject to inadvertent falling during handling.

Figure 7:
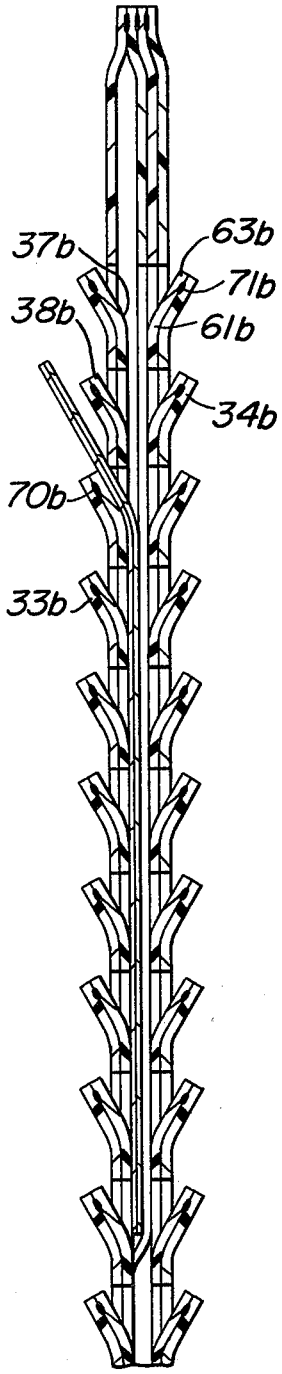
FIG. 7 is a sectional elevational view similar to FIG. 6, but showing a slightly modified embodiment of the present invention.

In the embodiment of FIG. 7, the construction is generally similar to that of the holder 20 shown in FIGS. 1, 3, 5 and 6, but with the difference that the bight regions 38b and 63b of the formations 37b and 61b are secured to their respective flaps 33b and 34b, adjacent to the medial edge portions of the flaps and remote from the flap creases or hinges. Thus, the securements or welds 70b and 71b of the embodiment shown in FIG. 7, corresponding to the securements or welds 70 and 71 of the first described embodiment, are located proximate to the distal or upper edges of bight portions 38b and 63b, and of the associated flaps 33b and 34b. By this location of the securement means or welds 70b and 71b, the upper portions of the inner sheet formations are constrained to outward swinging movement with their adjacent flaps to prevent obstructing the passage of microfiche and permit of single handed microfiche insertion and withdrawal.

Figure 8:
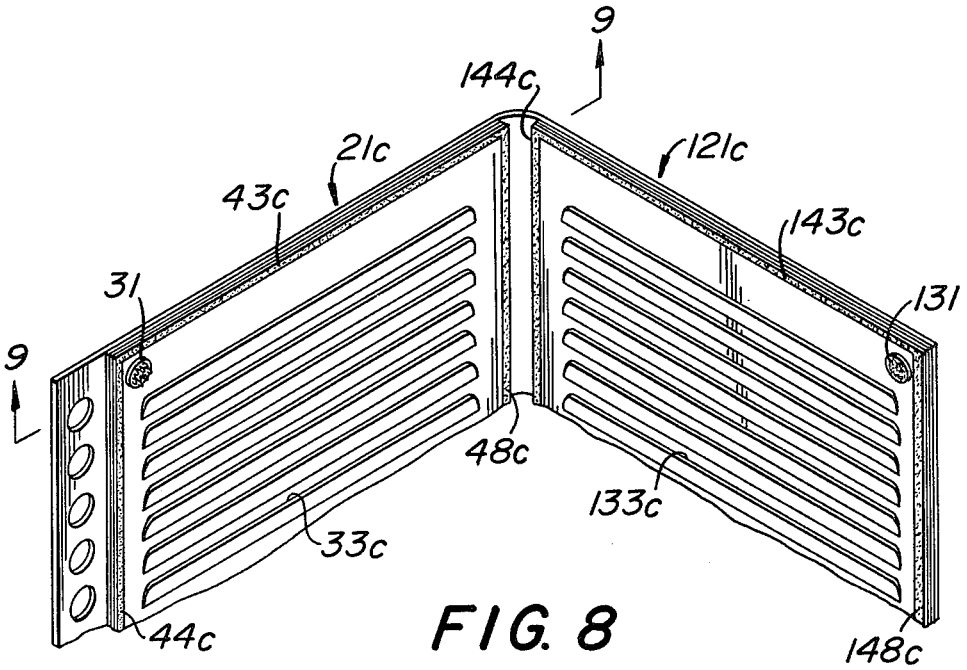
FIG. 8 is a partial perspective view showing a hinged sectional microfiche storage device of the present invention, in an open condition.
Figure 9:
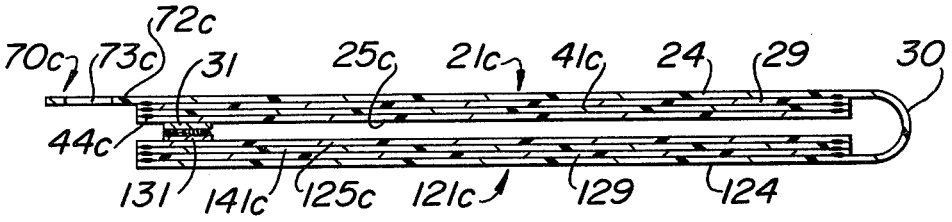
FIG. 9 is a sectional view taken generally along the line 9—9 of FIG. 8, but showing the hinged sectional storage device in a closed condition.

The additional embodiment of FIGS. 8 and 9 includes a pair of microfiche panels 21c and 121c which may be provided with slot formations 33c and 133c similar to those of the hereinbefore described embodiments. The panels 21c and 121c may each include a circumferential securement or circumferentially extending weld, as at 43c and 143c, which each may include a pair of laterally spaced, vertical securement zones or welds and a pair of vertically spaced horizontally extending securement zones or welds. The vertically extending securement zones or welds of panel 21c are shown at 44c and 48c, and the corresponding vertical securement zones or welds of panel 121c are shown at 144c and 148c.

As may be seen in the cross-sectional view of FIG. 9, panel 21c may include an outer sheet 25c, and an inner sheet 41c, cut and secured in the same manner as the corresponding sheets 25 and 41 of the first described embodiment. In addition, an outer sheet or panel 24 may be provided on the opposite side of inner sheet 41c as outer sheet 25c, and a barrier sheet or panel 29 may be interposed between the inner sheet 41c and outer sheet 24. The outer sheet 24 may be fabricated of flexible plastic material, having plasticizer, and the barrier sheet 29 may be interposed between the outer sheet 24 and inner sheet 41c to prevent appreciable contact of stored microfiche with the flexible outer sheet 24. Thus, the barrier sheet 29 may be continuous and imperforate, as may be the outer flexible sheet 24.

The complementary panel 121c may also include an outer layer 125c and inner layer 141c, a barrier layer 129 and an additional outer layer 124, corresponding to the above described layers 25c, 41c, 29 and 24.

The panels 21c and 121c are hingedly connected together for relative swinging movement between their illustrated positions of FIGS. 8 and 9 by suitable flexible connection or hinge means 30, which is an integral extension of and between the flexible outer layers 24 and 124 and define therewith an integral sheet of flexible vinyl. Further, remote from the integral hinge connection 30, extending along and beyond the edge securement 44c, there is provided a mounting structure 70c, which may be defined by an integral extension of the material of outer wall 124 to provide a flexible mounting extension or flap 72c. The mounting extension or flap may be provided with a series of through apertures or holes 73c for mounting on pins or rings, as desired. In addition, the panels 21c and 121c may be provided with mating fastener elements 31 and 131, say of complementary Velcro members, or the like, for detachably securing the panels in their closed, facing relation of FIG. 9.

From the foregoing, it is seen that the present invention provides a microfiche storage device which is relatively easy to use, as by one hand operation, versatile to accommodate different sizes and thicknesses of stored articles all with desired holding force, adaptable to a variety of mounting means, including bars, rods, pins, rings, and other, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A storage device for microfiche cards or the like, said device comprising an outer sheet having front and back faces, said outer sheet being formed with a plurality of slits each having a laterally extending medial portion and downturned extreme end portions, said outer sheet having a crease extending between the extreme end portions of each slit, the outer sheet material defined within each slit and its associated crease providing a flap swingable forwardly about the respective crease to open a slot for removably receiving microfiche, an inner sheet in facing relation with the back face of said outer sheet, said inner sheet having a plurality of generally inverted U-shaped cuts in nesting relation with each other, said cuts defining of the inner sheet material between adjacent pairs of cuts a plurality of generally inverted U-shaped sheet formations in nesting relation with each other, said sheet formations each including an upper portion free of said inner sheet and a pair of legs depending from said upper portion to junctions with said inner sheet, formation securing means securing said upper formation portions to said flaps upwardly of said creases for outward swinging of said upper formation portions with said flaps and unobstructed reception of microfiche into said slots for entry between an adjacent pair of said sheet formations into edge engagement with said leg junctions.

2. A storage device according to claim 1, in combination with circumferential securing means securing said outer and inner sheets together generally about the circumference thereof to define a unitary assembly, and a mounting structure comprising a tube extending along said one edge, and a separate flexible connection sheet connecting said tube to the adjacent edge of said assembly.

3. A storage device according to claim 2, said tube being relatively stiff plastic, and said flexible connection sheet being relatively flexible plastic welded to said assembly and tube.

4. A storage device for microfiche cards or the like, said device comprising an outer sheet having front and back faces, a plurality of generally parallel slots formed in said outer sheet for removably receiving microfiche, an inner sheet in facing relation with the back face of said outer sheet, said inner sheet having a plurality of generally inverted U-shaped cuts in nesting relation with each other, said cuts defining of the inner sheet material between adjacent pairs of cuts a plurality of generally inverted U-shaped sheet formations in nesting relation with each other, said sheet formations each including an upper portion free of said inner sheet and a pair of legs depending from said upper portion to junctions with said inner sheet, formation securing means securing said upper formation portions to said outer sheet at locations between said slots, circumferential securing means securing said outer and inner sheets together generally circumferentially thereof to define a unitary assembly, a mounting structure extending along one edge of said assembly for mounting to a support, and an additional outer sheet having front and back faces, an additional plurality of generally parallel slots formed in said additional outer sheet for removably receiving microfiche, an additional inner sheet in facing relation with the back face of said additional outer sheet, said additional inner sheet having a plurality of generally inverted U-shaped cuts in nesting relation with each other, said cuts of said additional inner sheet defining of the additional inner sheet material between adjacent pair of cuts a plurality of generally inverted U-shaped additional sheet formations in nesting relation with each other, said additional sheet formations each including an upper portion free of said additional inner sheet and a pair of legs depending from said upper portion to junctions with said additional inner sheet, additional formation securing means securing said upper formation portions of said additional inner sheet to said additional outer sheet at locations between the slots of said additional outer sheet, additional circumferential securing means securing said additional outer and inner sheets together generally circumferentially thereof to define an additional unitary assembly, and a flexible connection sheet extending between one edge of said additional assembly and another edge of said first mentioned assembly to hingedly connect together said assemblies for relative swinging movement thereof into and out of facing relation with respect to each other, said connecting sheet and mounting structure being defined by an integral sheet extending entirely across the back side of said additional assembly, thence between said assemblies, thence entirely across the back side of said first mentioned assembly, and thence along said one edge of said first mentioned assembly.

5. A storage device according to claim 4, in combination with Velcro fastener means on said first mentioned and additional assemblies for detachable securement thereof in said facing relation.

6. A storage device according to claim 4, said integral sheet being fabricated of flexible vinyl, and a barrier sheet interposed between each of said assemblies and the adjacent portion of said integral sheet to separate the latter from received microfiche, said barrier sheet being fabricated of rigid plastic.

* * * * *